United States Patent [19]

Hollenbeck, Jr.

[11] 4,280,028

[45] Jul. 21, 1981

[54] BOAT BATTERY SELECTOR SWITCH COMBINED WITH LOCK

[75] Inventor: Leroy F. Hollenbeck, Jr., Miami, Fla.

[73] Assignee: Perko, Inc., Miami, Fla.

[21] Appl. No.: 120,230

[22] Filed: Feb. 11, 1980

[51] Int. Cl.[3] ..... H01H 9/28; H01H 19/20

[52] U.S. Cl. ..... 200/44; 200/155 R

[58] Field of Search ..... 200/44, 42 R, 11 R, 200/11 J, 11 TW, 155 R, 61.64

[56] References Cited

U.S. PATENT DOCUMENTS

| | | | |
|---|---|---|---|
| 3,141,933 | 7/1964 | Gauthier | 200/44 |
| 3,260,808 | 7/1966 | Dimond et al. | 200/42 T |
| 3,821,501 | 6/1974 | Parmenter | 200/155 R |

FOREIGN PATENT DOCUMENTS

| | | | |
|---|---|---|---|
| 2536863 | 4/1977 | Fed. Rep. of Germany | 200/44 |
| 2550861 | 4/1977 | Fed. Rep. of Germany | 200/44 |

*Primary Examiner*—Willis Little

*Attorney, Agent, or Firm*—Gilbert L. Wells

[57] ABSTRACT

Single pole, triple throw battery selector switches are provided with locks to prevent unauthorized use. Rotation is prevented between the selector knob and housing by having a semi-circular groove with a locking position at the end thereof in the top cover of the battery selector switch and a locking pin projecting from the underside of the selector knob into engagement with the grooves. The selector knob is locked with the batteries disengaged when the locking pin engages the locking position groove by turning a locking cylinder with a key.

3 Claims, 5 Drawing Figures

FIG. 2
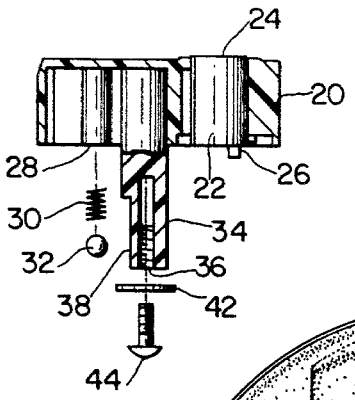
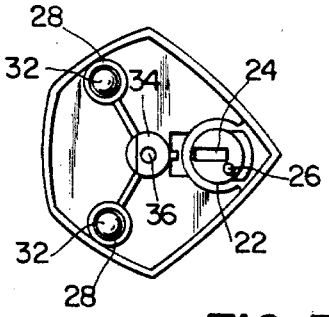
FIG. 3
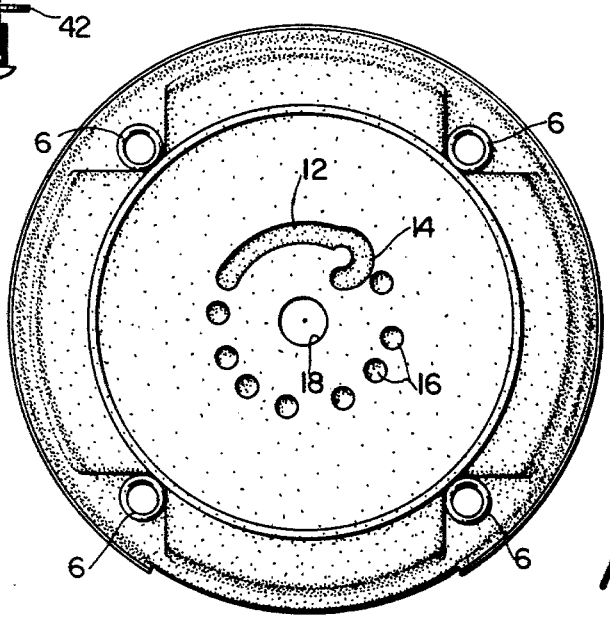
FIG. 4
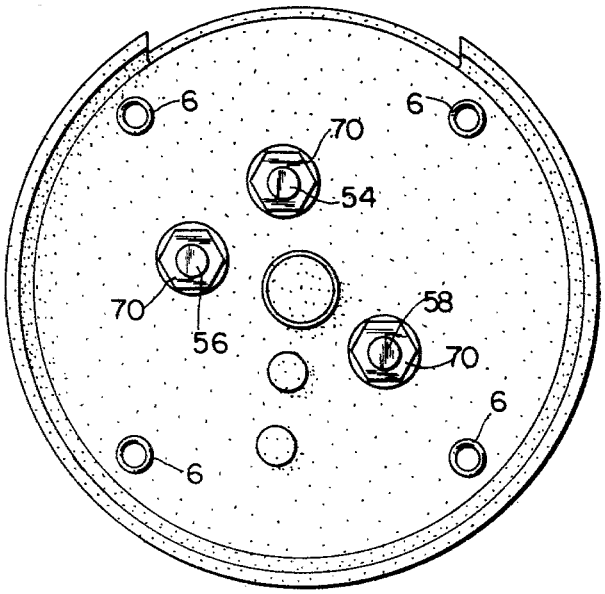
FIG. 5

BOAT BATTERY SELECTOR SWITCH COMBINED WITH LOCK

CROSS REFERENCE TO A RELATED APPLICATION

The disclosure of design application Ser. No. 068,814, filed Aug. 22, 1979 and showing the design views of the present invention is incorporated herein.

BACKGROUND OF THE INVENTION

The field of the invention is electricity, circuit makers and breakers having a lock for unauthorized use prevention. Marine battery selector switches are the particular concern of the present invention.

Marine battery selector switches of the prior art have, for the most part, been sold without an unauthorized use provision. Along with the great increase in pleasure boat use and ownership there has been an upsurge in vandalism and unauthorized use.

Because an owner is not aboard his boat at all times and it is impossible to maintain security thereof, there is a need for a lock on the ignition or more particularly the battery selector switch.

SUMMARY OF THE INVENTION

Having in mind the limitations of the prior art where marine battery main switches are unlocked, it is an object of the present invention to provide a boat battery selector switch with a lock.

This object is achieved in the present invention wherein a single pole, triple throw battery selector switch is provided with a lock to prevent rotation between the selector knob and the switch cover.

BRIEF DESCRIPTION OF THE DRAWINGS

The invention may be best described by reference to the drawings appended hereto, wherein:

FIG. 2 is a detailed showing in cross-section of the selector knob along the lines 2—2 of FIG. 1;

FIG. 3 is a detailed bottom plan view of the selector knob of FIG. 1;

FIG. 4 is a top plan view of the cover of FIG. 1 along the line 4—4 showing the control and locking grooves in the cover; and FIG. 5 is a bottom plan view of FIG. 1.

DESCRIPTION OF PREFERRED EMBODIMENTS

Figure 1:
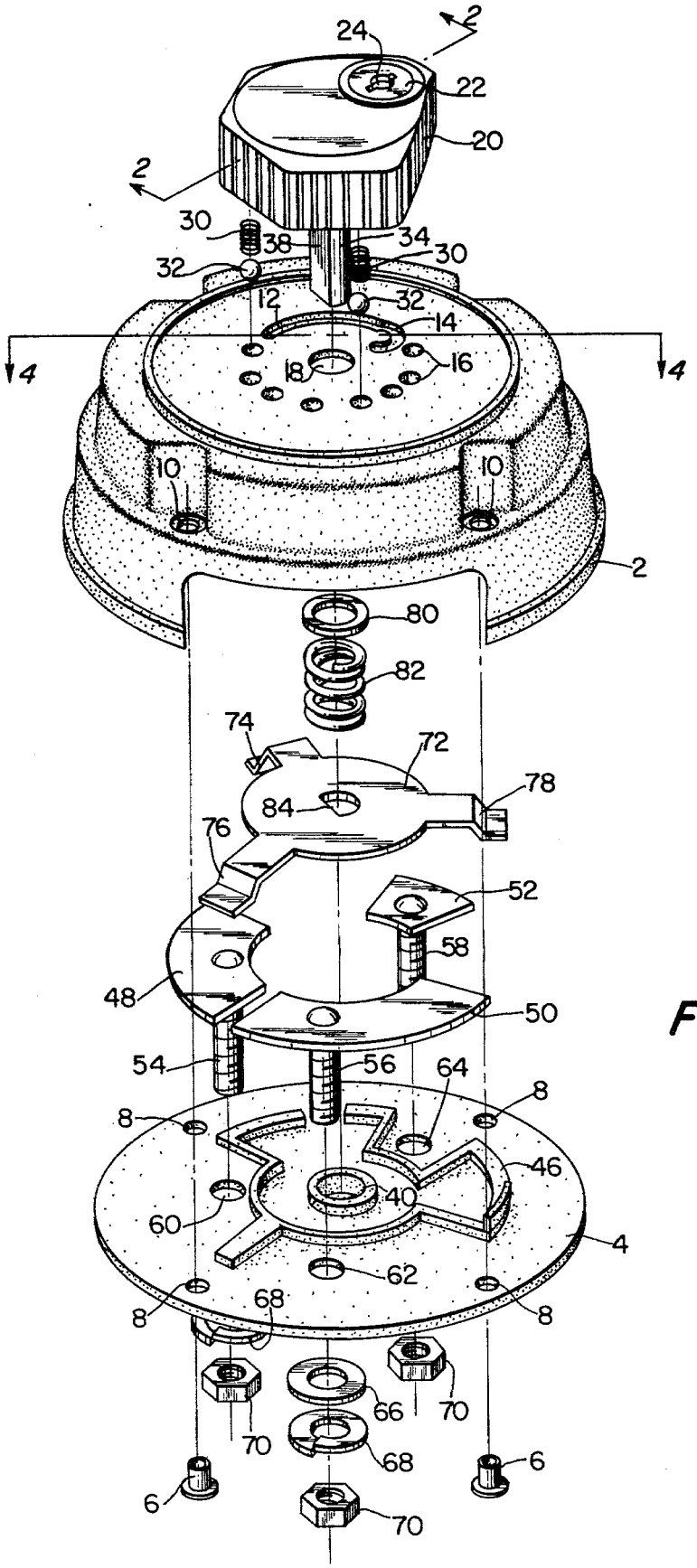
FIG. 1 is an exploded perspective view of the present invention.

With particular reference to FIG. 1, the selector switch of the present invention is shown having a plastic cover or housing 2.

An insulating plastic bottom plate 4 is secured to the cover 2 by ultrasonic welding. Brass grommets 6 are installed through holes 8 of bottom plate and holes 10 of the cover which provides additional support for the mounting screws or bolts.

The top of the cover 2 has a semi-circular travelling groove 12 with a second semi-circular locking position 14 of smaller diameter at the right end thereof. A plurality of spherical detents 16 and the travelling groove 12 describe a circle about hole 18 through the middle of the top of the cover 2.

Selector knob 20 has a lock cylinder 22 with keyhole 24 therein. The lock cylinder 22 has a lock pin 26 on the underside of the knob for locking the selector knob. Lock pin 26 is rotated into locking position 14 by insertion of a key into keyhole 24 for clockwise rotation of the locking cylinder.

Cylindrical recesses 28 on the underside of the knob 20 guide stainless steel coil springs 30 which maintain stainless steel balls 32 under compression into spherical detents 16. Knob 20 rotates on spindle 34 having a cylindrical hole 36 and a flat side 38. Spindle 34 is passed through hole 18 and secured on the bottom side of hole 40 of plate 4 by a washer 42 and a screw 44.

Bottom plate 4 constructed of insulating plastic has insulating plastic ridge 46 for separating each from one another the copper battery contacts 48, 52 and ground 50. The copper contacts have brass terminals 54, 56 and 58, respectively which pass through holes 60, 62 and 64, respectively and are held in place by brass washers 66, lock washers 68 and nuts 70.

Rotating copper contact 72 has three throws 74, 76 and 78 and a hole in the middle with a flat side 80 for engagement with the flat side 38 of spindle 34. Rotating contact 72 is maintained in compressive contact with contacts 48, 50, 52 and/or ridge 46 by washer 80 and coil spring 82.

In the position where knob 20 is rotated clockwise to the locking position with lock pin 26 engaged with locking position 14, the throw 76 is in contact with ground 50 and throws 74 and 78 ride on insulating ridge 46.

As knob 20 is rotated counterclockwise one click the throw 78 connects with contact while throw 76 maintains its connection with ground 50 and the first battery is thereby actuated.

A second click to the left places throws 74, 76 and 78 in connection with contacts 48, 50 and 52, respectively and both batteries are then connected in parallel. A third click to the left places throws 74 and 76 in contact with the second battery contact 48 and ground 50, while throw 78 rides on ridge 46 and only the second battery is connected up.

In order to lock the ignition and disconnect both batteries, the knob is rotated all the way to the right, a key is inserted into keyhole 24, the locking cylinder is rotated so that locking pin 26 engages locking position 14 and then the key is removed.

With the battery selector switch locked it is impossible to connect the batteries and start the engines.

I claim:

1. A single pole, triple throw selector switch for boat batteries having:

(a) a housing for said selector switch with a hole through the top center thereof;

(b) a travelling groove describing a semi-circle about said hole on said top center of the housing;

(c) a locking position groove at one end of said travelling groove;

(d) a selector knob having a spindle inserted for rotation in said hole; and (e) a locking cylinder mounted for rotation by a key in said selector knob and having a locking pin projecting from the bottom thereof for engagement with said travelling and locking position groove.

2. The selector switch of claim 1, wherein said locking position groove is semi-circular with a diameter less than the diameter of said travelling groove and equal to the diameter described by rotation of said locking pin in the locking cylinder.

3. The selector switch of claim 2, further comprising spherical detents in said top center of the housing located in said circle about said hole described by said travelling groove and balls compressable therein projecting from the underside of said selector knob.

* * * * *